US007950876B2

(12) United States Patent
Suver

(10) Patent No.: US 7,950,876 B2
(45) Date of Patent: May 31, 2011

(54) SOCKET WRENCH ATTACHMENT FOR ROTARY DRIVE MEMBER

(76) Inventor: Paul W. Suver, Seattle, WA (US)

( * ) Notice: Subject to any disclaimer, the term of this patent is extended or adjusted under 35 U.S.C. 154(b) by 326 days.

(21) Appl. No.: 12/288,609

(22) Filed: Oct. 21, 2008

(65) Prior Publication Data

US 2010/0098502 A1 Apr. 22, 2010

(51) Int. Cl.
*E02D 7/22* (2006.01)

(52) U.S. Cl. ..... 405/232; 405/252.1; 405/253

(58) Field of Classification Search ..... 405/231, 405/232, 251, 252.1, 253, 254
See application file for complete search history.

(56) References Cited

U.S. PATENT DOCUMENTS

| | | | | |
|---|---|---|---|---|
| 4,239,419 | A * | 12/1980 | Gillen, Jr. | 405/232 |
| 4,708,530 | A * | 11/1987 | Faber | 405/252 |
| 4,911,581 | A * | 3/1990 | Mauch | 405/232 |
| 5,544,979 | A | 8/1996 | White | |
| 5,944,452 | A * | 8/1999 | Reinert, Sr. | 405/232 |
| 6,305,882 | B1 * | 10/2001 | Coast et al. | 405/232 |
| 6,524,032 | B2 | 2/2003 | Russell et al. | |
| 6,942,430 | B1 * | 9/2005 | Suver | 405/252.1 |
| 7,377,723 | B2 * | 5/2008 | Nolan | 405/252.1 |
| 2005/0031418 | A1 * | 2/2005 | Whitsett | 405/252.1 |

FOREIGN PATENT DOCUMENTS

JP 2004-218214 5/2004

* cited by examiner

*Primary Examiner* — Frederick L Lagman
(74) *Attorney, Agent, or Firm* — Patentique PLLC

(57) ABSTRACT

A socket wrench attachment (SRA) is connected by a circular array of bolts (28) connecting the mounting flange (30) to the rotary output member (22) on a rotary output shaft (20). The shaft (20) is a part of a rotary drive mechanism (12) which is mounted for longitudinal travel along a tower (14).

4 Claims, 8 Drawing Sheets

SOCKET WRENCH ATTACHMENT FOR ROTARY DRIVE MEMBER

TECHNICAL FIELD

The present invention relates to apparatus for placing sectional steel pipe piling into the ground. More particularly, it relates to the provision of a socket wrench attachment for a machine that is designed for rotating an auger for forming an augered cast-in-place pile, such attachment adapting such machine for installing sectional steel pipe piling.

BACKGROUND OF THE INVENTION

A known procedure for constructing a reinforced concrete piling utilizes an auger with a hollow auger stem. The upper end of the auger is attached to the rotary output member of a drive mechanism that is on a carriage. In use the carriage, the drive mechanism and the auger are moved downwardly along a guide tower while the auger is being rotated. Once the auger is in the ground a desired distance, fluid concrete is pumped through the auger stem which is hollow. As fluid concrete is introduced, the auger is withdrawn from the hole. After the auger is out of the hole, reinforcing steel is inserted into the upper part of the concrete.

My U.S. Pat. No. 6,942,430, granted Sep. 13, 2005, and entitled Rotary Driver For Pipe Piling, provides an apparatus for placing steel pipe piling in the ground. The steel pipe piling has a bottom section that includes flutes for pulling the pipe section into the ground as it is being rotated. Additional pipe sections are added and the pipe piling is rotated until the pipe piling is sufficiently deep in the ground.

There is a need for adapting the auger rotating machinery for use to place steel pipe piling into the ground. The primary object of the present invention is to fill this need.

BRIEF SUMMARY OF THE INVENTION

According to the present invention, a rotary drive mechanism is guided endwise downwardly while its output is being rotated. The rotary drive mechanism includes a rotary output member on a rotary output shaft. Splines are provided between the rotary output member and the rotary output shaft, allowing the output member to move relatively along the output shaft while both are rotated about a common axis of rotation.

An aspect of the present invention is to provide a rotary socket wrench attachment for the rotary output member. In preferred form, this rotary socket wrench attachment has an upper end mounting flange, a lower end socket wrench, and a reduced diameter neck axially between the mounting flange and the socket wrench. The socket wrench includes an axial socket having internal wrench flats. An array of bolt fasteners surround the axis of rotation radially outwardly and endwise of the axial socket. These fasteners connect the mounting flange of the socket wrench attachment to the rotary output member. The steel pipe piling is made up of a number of pipe sections. The upper end of each pipe piling section fits into the socket of the socket wrench attachment and has wrench flats that engage the wrench flats in the socket. The upper end portion of each steel piling section is movable axially within the axial socket. The rotary socket wrench attachment is movable axially on the splines. During rotation of the drive mechanism, the splines transmit torque from the output shaft to the output member and the wrench flats in the socket of the output member transmit torque from the socket wrench to the rotary steel piling.

Preferably, the rotary drive mechanism is mounted on a carriage that is movable up and down along a tower. The tower is movable to a piling site and is positioned+ at the site while the rotary drive mechanism is employed for rotating the steel pipe piling to move it in the ground at the site.

According to the invention, the socket wrench socket has an annular wall. The bolt fasteners lie on a circle that is radially between the inner and outer side surfaces of the socket wrench socket. Rotary torque is transmitted by the rotary output shaft then to the rotary output member, from the rotary output member, to the circular array of bolts, and from the bolts to the upper end mounting flange of the rotary socket wrench attachment. This torque is transmitted by the mounting flange to the neck of the attachment and from the neck to the side wall of the socket of the socket wrench socket. This torque is then transmitted by the wrench flats in the socket wrench to the wrench flats on the section of rotary pipe piling that is engaged by the socket.

These and other inherent objects, features, advantages and characteristics of the present invention will be apparent from the following description of a typical and therefore a non-limitive embodiment of the invention.

BRIEF DESCRIPTION OF THE SEVERAL VIEWS OF THE DRAWINGS

In the drawing, like letters and numerals refer to like parts throughout, and.

DETAILED DESCRIPTION OF THE ILLUSTRATED EMBODIMENT

Figure 1:
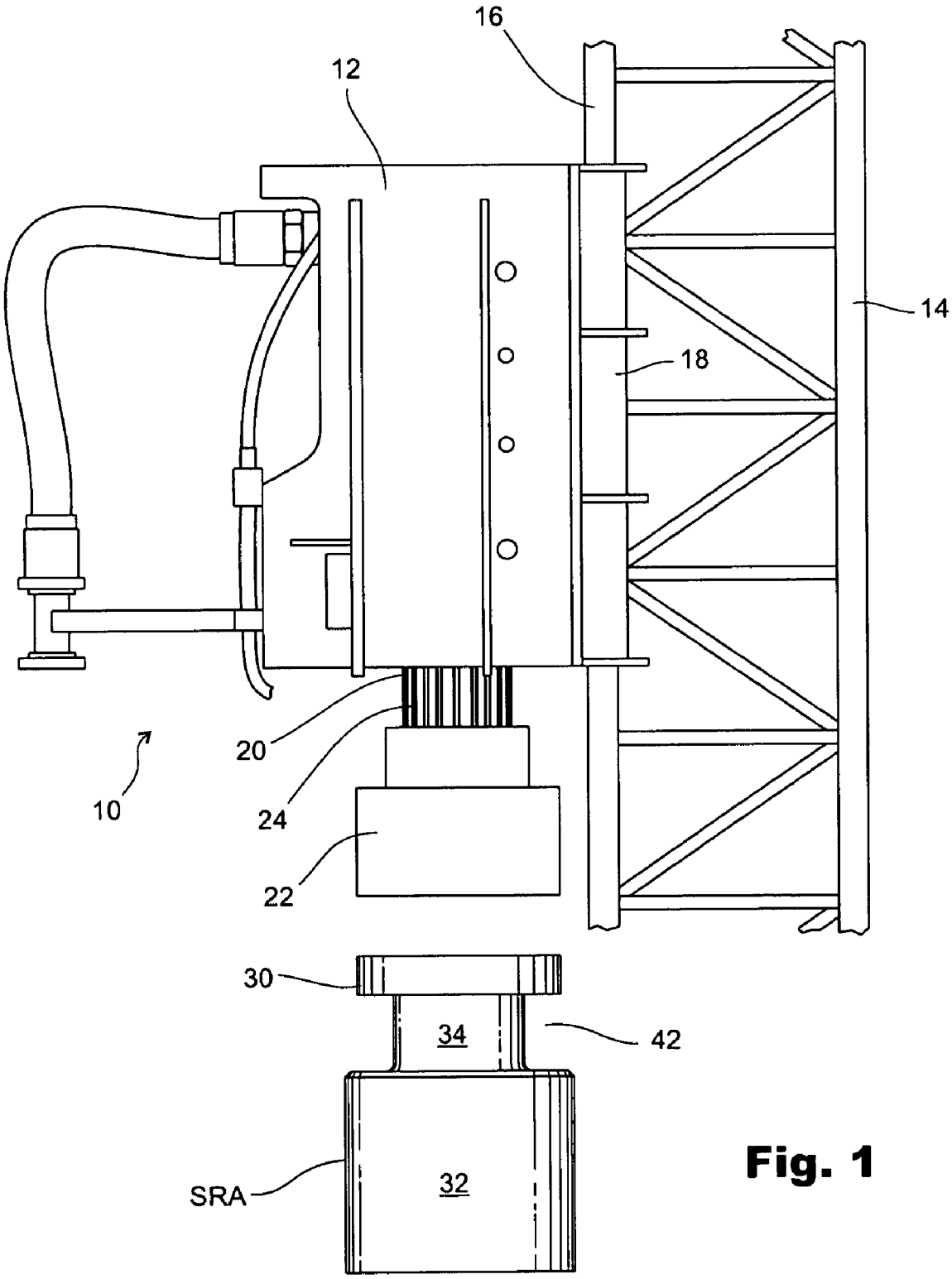
FIG. 1 is a fragmentary side elevational view of a rotary drive mechanism and a support tower on which it is mounted and guided for up and down movement, said view showing an output member spline connected to an output shaft, and showing a socket wrench attachment spaced axially from the output member.
Figure 2:
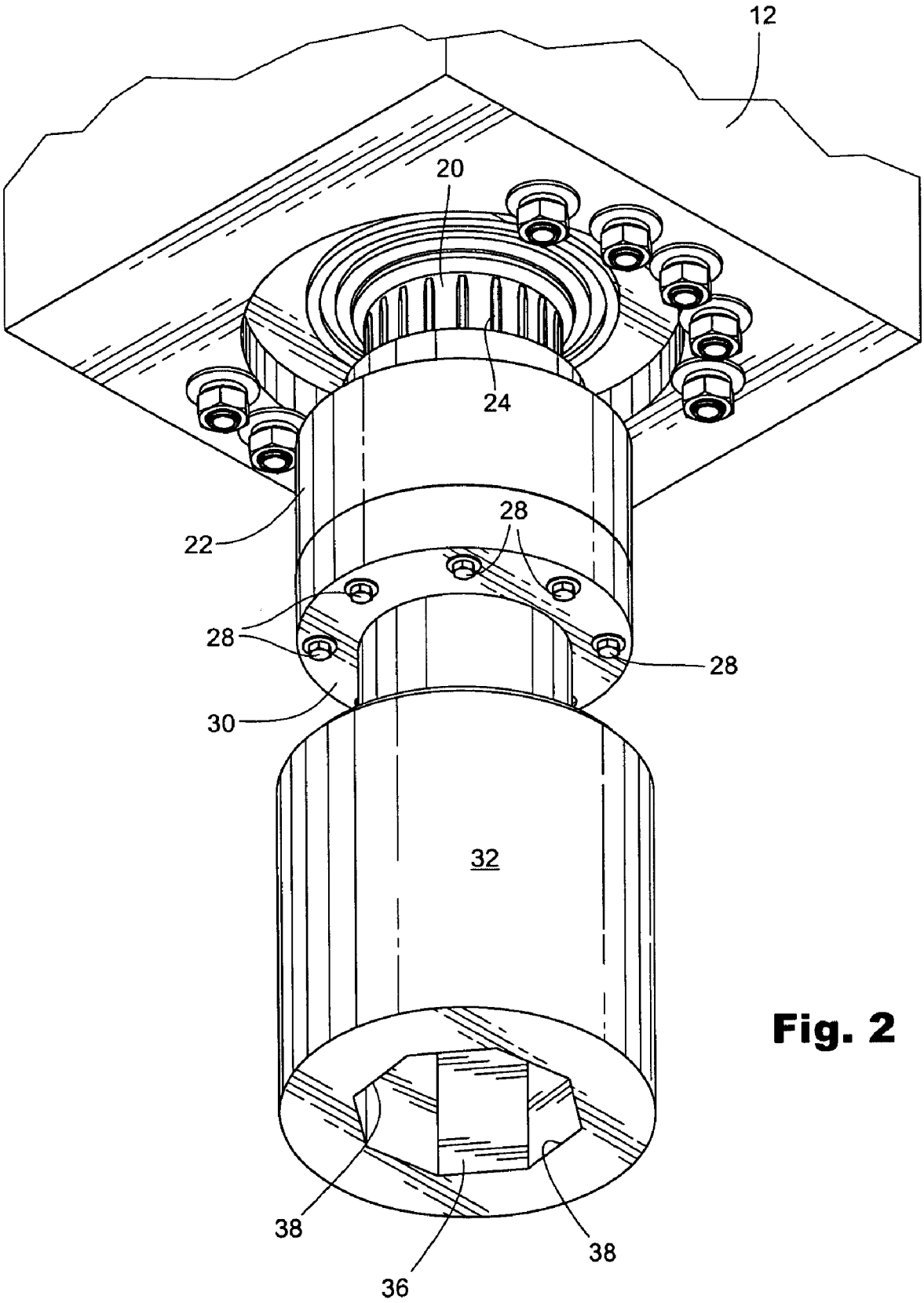
FIG. 2 is a fragmentary pictorial view of the socket wrench attachment of FIG. 1 secured to the output member of FIG. 1.
Figure 3:
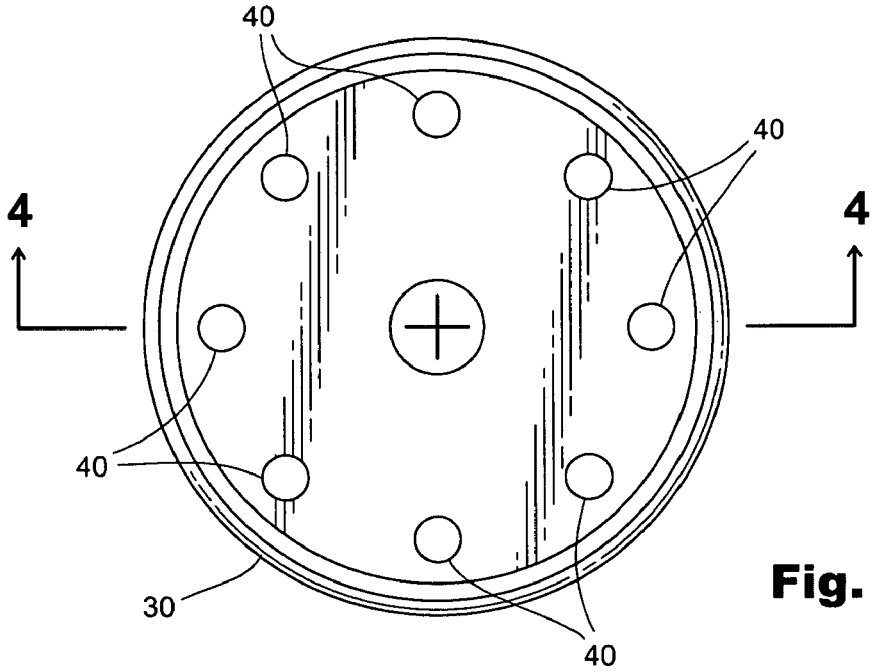
FIG. 3 is a top plan view of the socket wrench attachment shown by FIG. 4.

FIG. 1 is a fragmentary view of a rotary drive assembly 10 that is a part of an apparatus for rotating an auger (not shown)

that is used in auger cast pile construction. The drive assembly 10 is shown to include a carriage 12 that is movable up and down along a support tower 14. The tower 14 includes what may be termed a track 16. The carriage 12 includes mounting structure 18 that is adapted to engage the track 16 and move up and down along the track 16 when caused to do so by a hydraulic cylinder (not shown) or the like, in known fashion.

The tower 14 is constructed very much the same way that a crane boom is constructed. It is a truss composed of longitudinal, lateral and diagonal members connected together in the manner illustrated.

The drive mechanism includes a rotary output shaft 20 and a rotary output member or turret 22 that is mounted onto the output shaft 20 by a series of splines 24. The splines 24 allow for up and down movement of the rotary drive member 22 along the rotary output shaft 20. The splines 24 also transmit torque from the rotary output shaft 20 to the rotary output member 22 during rotation of the output shaft.

According to the invention, a socket wrench attachment 26 is connected to the rotary output member 22 by a circular array of bolt fasteners 28. The socket wrench attachment 26 includes a mounting flange 30, a rotary box wrench 32 and a reduced diameter neck portion 34 that is axially between the output member 22 and the box wrench 32.

Figure 4:
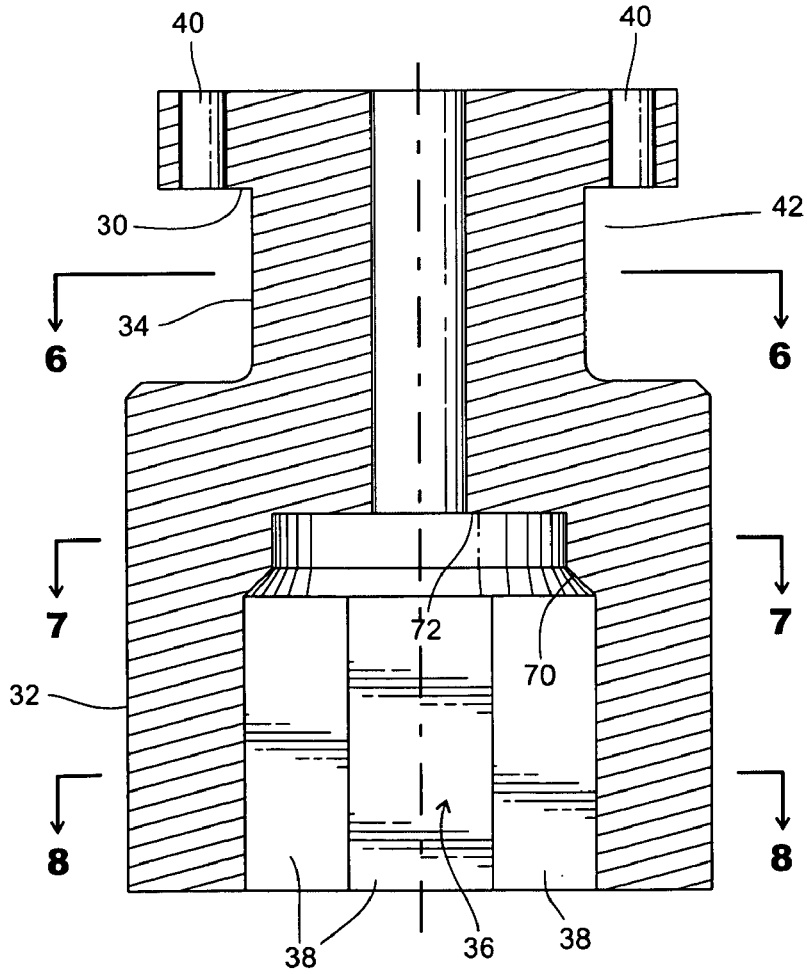
FIG. 4 is an axial sectional view of the socket wrench attachment shown by FIG. 3, taken substantially along line 4-4 of FIG. 3.
Figure 5:
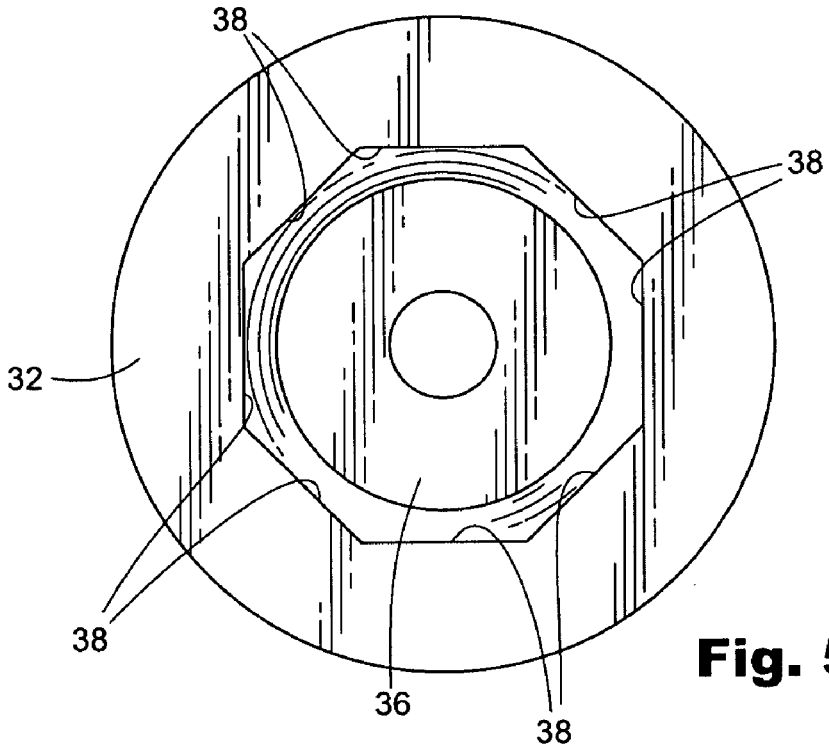
FIG. 5 is a bottom plan view of FIG. 4.
Figure 6:
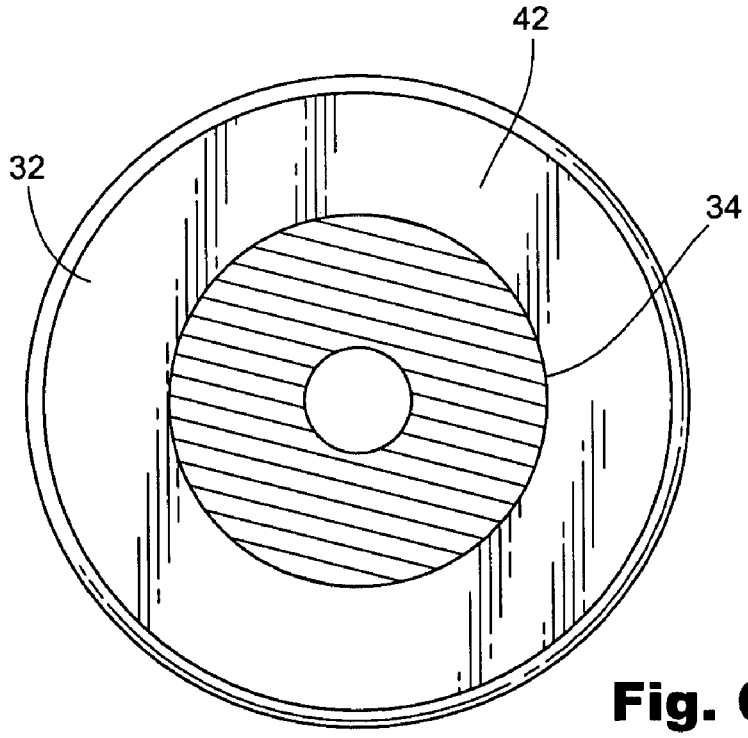
FIG. 6 is a sectional view taken substantially along line 6-6 of FIG. 4.
Figure 7:
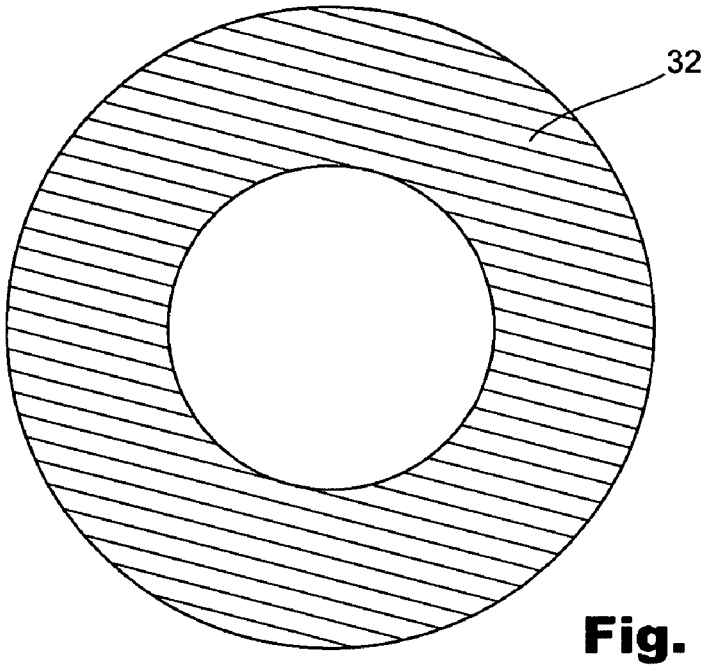
FIG. 7 is a sectional view taken substantially along line 7-7 of FIG. 4.
Figure 8:
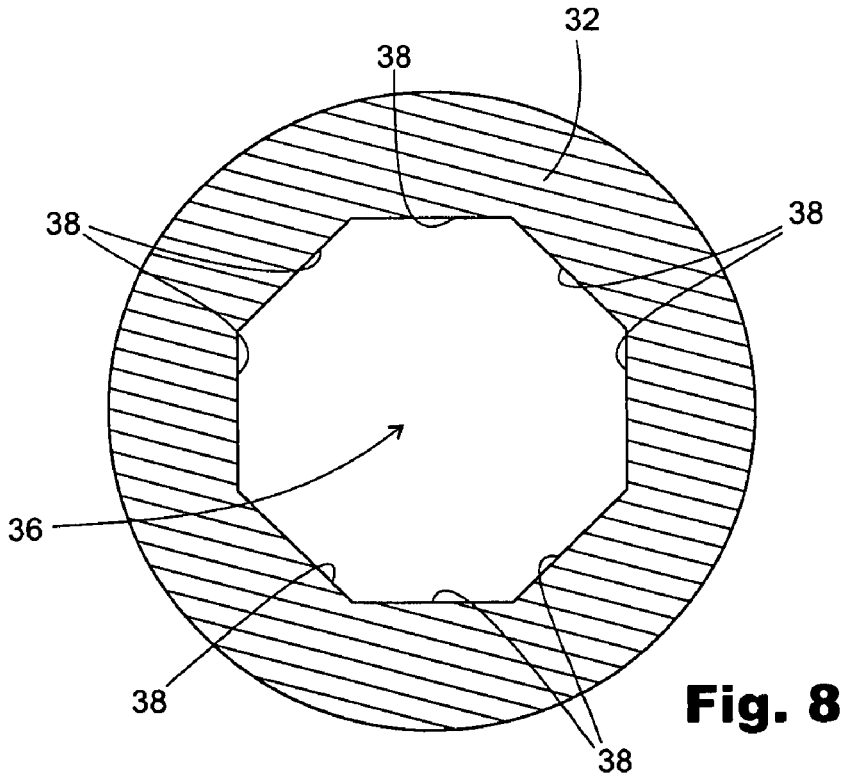
FIG. 8 is a sectional view taken substantially along line 8-8 of FIG. 4.

Referring to FIG. 4, the box wrench 32 includes a box wrench socket 36 that includes a plurality of internal wrench flats 38. In the illustrated example, the box wrench socket 36 includes eight wrench flats 38 forming an octagon socket.

Referring to FIG. 4, the flange 30 is formed to include a circular array of axial mounting screw-receiving openings 40. In the illustrated example there are eight screw fastener-receiving openings 40 spaced equal distances apart on a circle that is concentric with the box wrench attachment 26. The openings 40 extend along axial lines that are radially inwardly of the outer surface of the box wrench 32 and radially outwardly of the wrench flats 38. As best shown by FIG. 4, there is an annular space 42 formed around the neck 34 axially between the flange 30 and the box wrench 32. This space allows for easy access to the fasteners 28 during installation and removal of the attachment 26 onto and off from the rotary output member 22.

Figure 12:
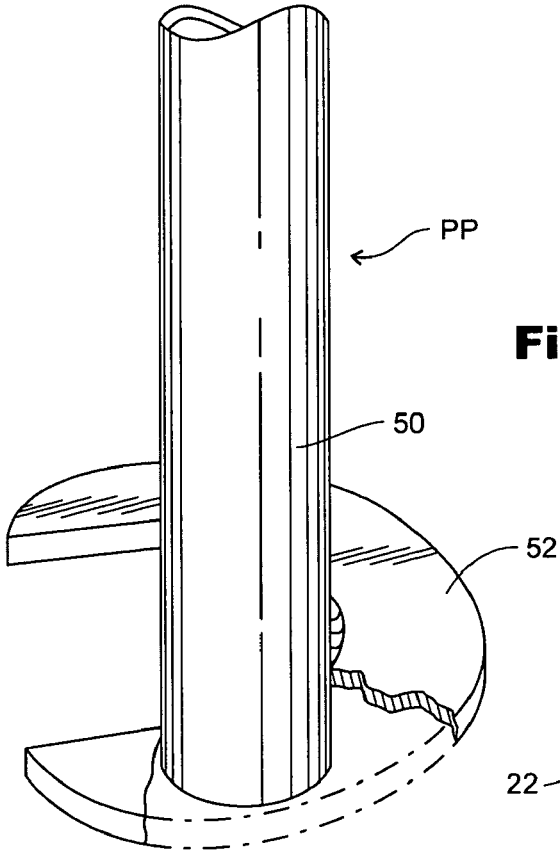
FIG. 12 is a fragmentary pictorial view of the lower end portion of a section of steel piling showing a helical flute provided for screwing the piling section into the ground.

Referring to FIGS. 9-12, the pipe piling PP may be a single member or it may be composed of a plurality of sections which are secured together in succession, such as by box and pin joints. Referring to FIG. 12, a single pipe section PP, or the lower section 50 of a sectional pipe piling PP, is provided with an auger flute 52 that is helical in shape and adapted to bore itself into the ground when the pipe piling PP is rotated.

Figure 9:
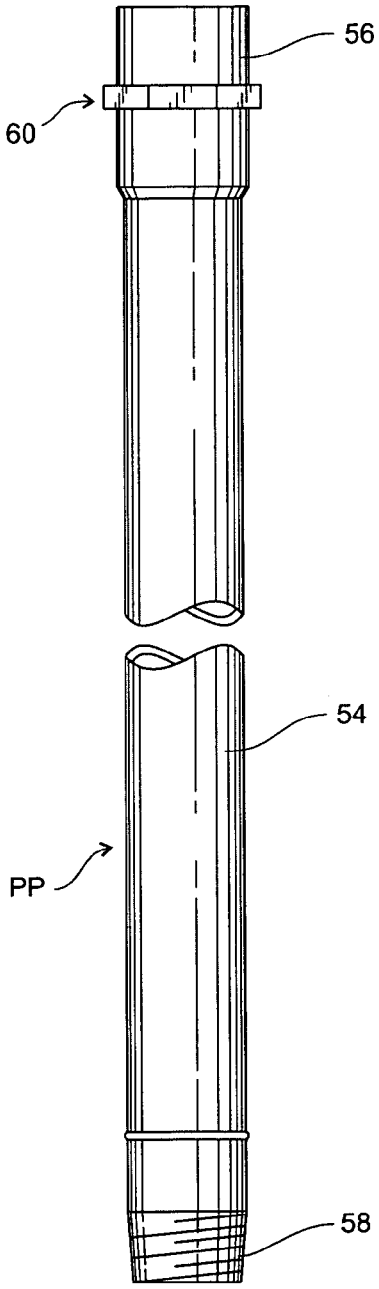
FIG. 9 is a fragmentary elevational view of a section of steel piling, having a "box" at its upper end and a "pin" at its lower end.
Figure 10:
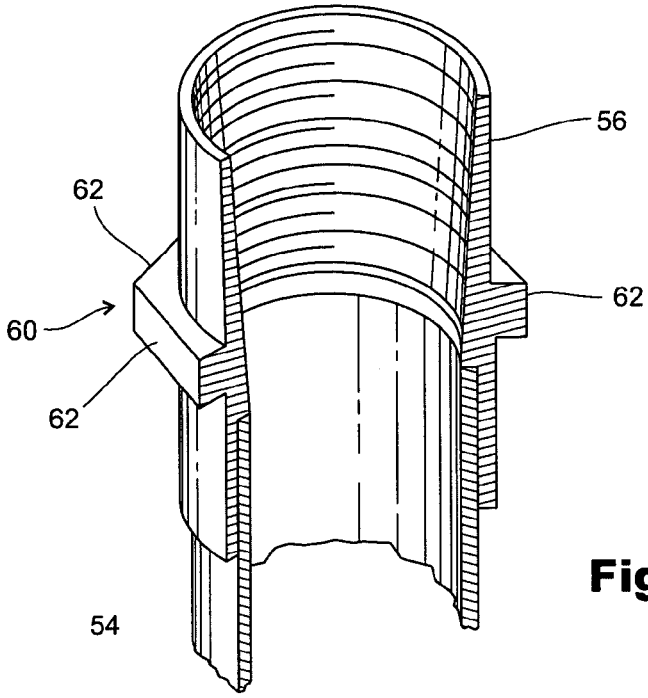
FIG. 10 is a fragmentary pictorial view of the "box" end of the steel piling section, with a foreground portion cut away so as to show the "box" component in section.
Figure 11:
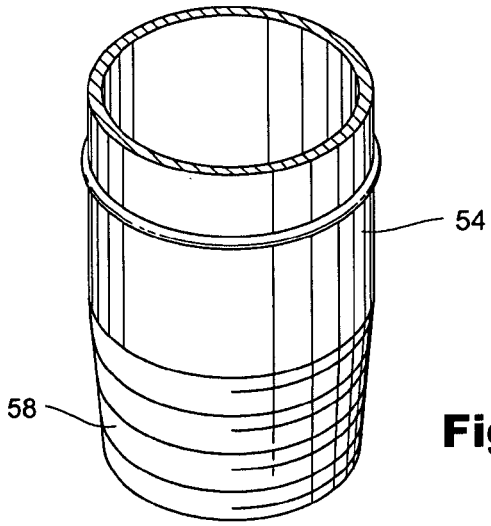
FIG. 11 is a fragmentary pictorial view of the "pin" end of the steel piling member.
Figure 13:
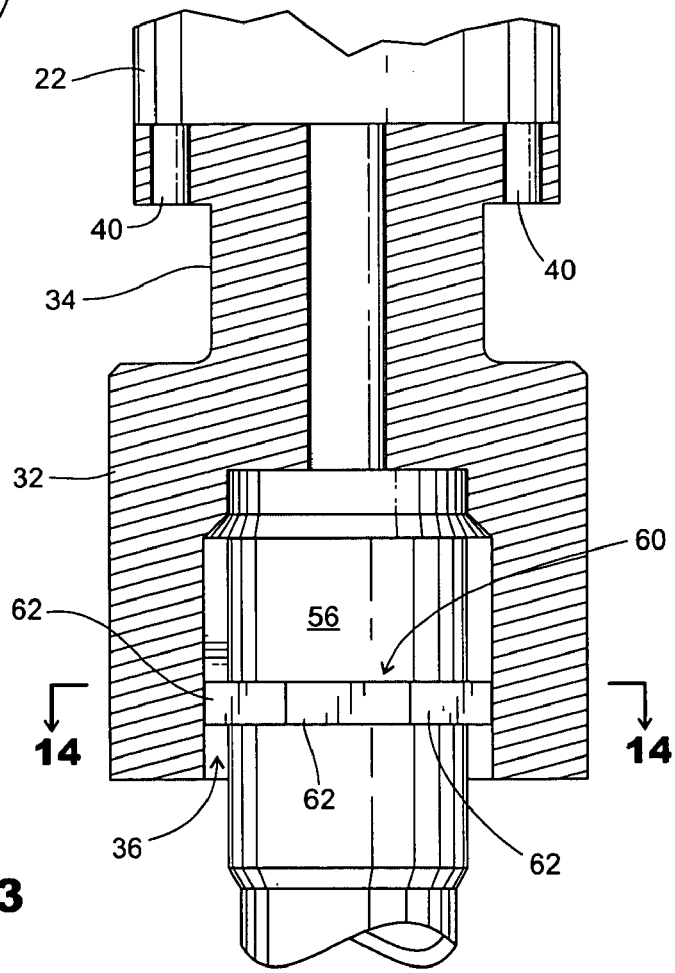
FIG. 13 is a view similar to FIG. 4 showing the upper end "box" portion of the section of steel piling positioned within the socket of the box wrench attachment.
Figure 14:
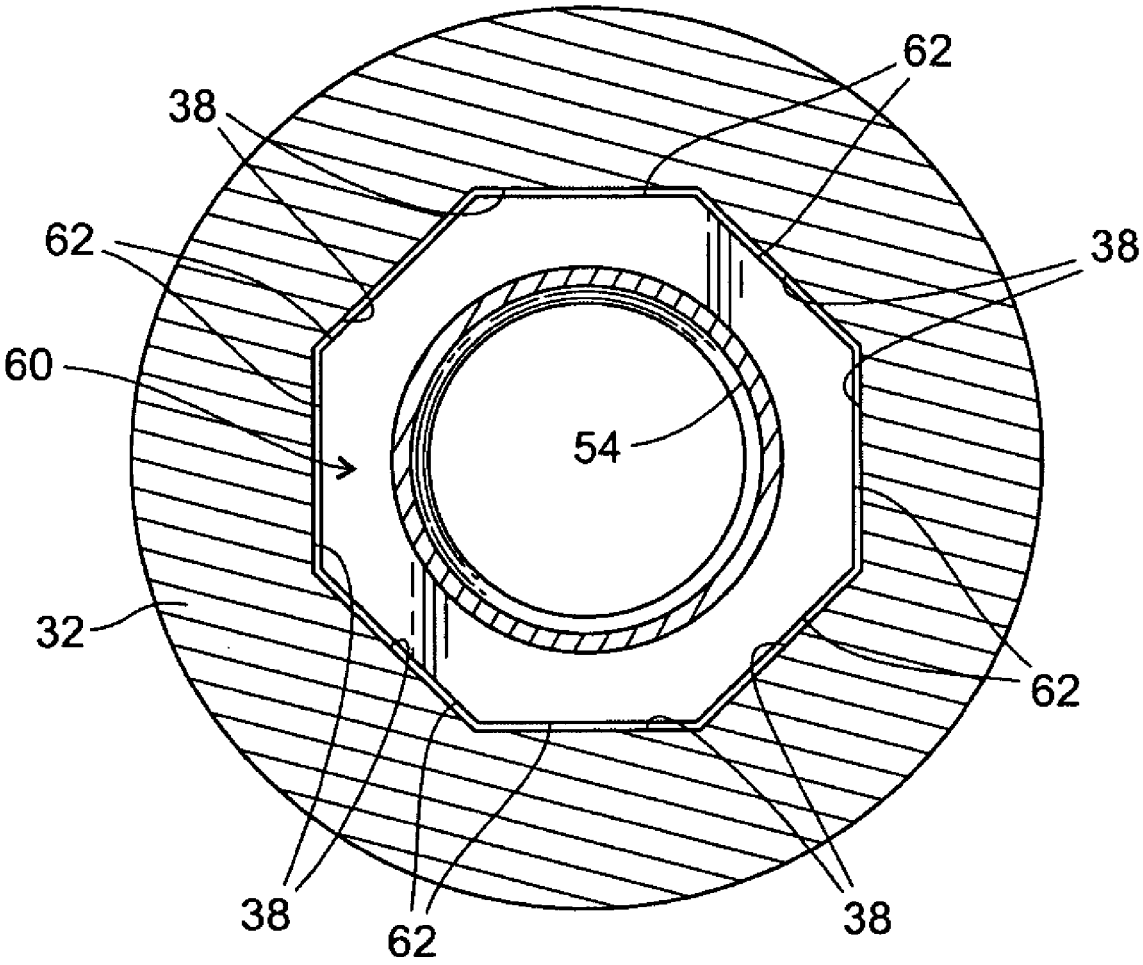
FIG. 14 is a sectional view taken substantially along line 14-14 of FIG. 13.

FIG. 9 shows one section 54 of a sectional pipe piling. In a sectional pipe piling PP, each section includes a "box" component 56 at its upper end. Each section, except for the lower section, includes a "pin" 58 at its lower end. Each pin 58 has external threads and each box 56 has internal threads. The threads 58 are adapted to screw into the threads 56 for connecting adjacent sections together. In the preferred embodiment, the "box" 56 is provided with an external ring 60 on which a set of wrench flats 62 are formed. These wrench flats 62 are complementary to the wrench flats 38 in the socket wrench socket 36. FIG. 13 shows a box 56 inside of a socket 36 and shows the wrench flats 62 contiguous the wrench flats 38.

When it is desired to place a pipe piling PP in the ground, the tower 14 is positioned along side the pipe piling location and the axis of rotation of the drive shaft 20, the drive member 22 and the socket wrench attachment 32 is positioned to be on the longitudinal axis of the pipe piling PP. Next, the carriage 12 is moved upwardly on the guide tower 14 until there is sufficient room below the rotary output member 32 to receive the lower section 50 of the pipe piling PP. The pipe piling member PP is placed into a vertical position with its box 56 directed upwardly. The pipe piling member PP is positioned with its auger end 52 on the ground and with its box end 56 directed upwardly in line with the socket 36. Then, the carriage is lowered so as to cause the box end portion 56 to move upwardly into the socket 36. When the box end 56 is within the socket 32, the wrench flats 62 on ring 60 are contiguous the wrench flats 38 in the socket 36. Then, the carriage 18 is moved downwardly and the drive mechanism is operated to rotate the output shaft 20 and the output member 22, and also rotate the socket wrench attachment 32. In the process, the ring 60 will move axially upwardly in the socket 36 and the output member 22 will slide upwardly along the splines 24. Rotation is continued and the carriage 12 is moved downwardly, the auger 52 to bore its way into the ground and moving the pipe sections PP downwardly into the ground.

When the box 56 is down close to the ground, the carriage 12 is raised and another steel pipe piling section PP is moved into place for attachment of its lower end to the upper end of the pipe piling section PP in the ground and the movement of its upper end into the socket 36 in the socket wrench 32. This procedure is repeated until the sectional pipe piling PP is sufficiently buried into the ground.

By way of typical and therefore non-limitive example, the socket wrench 32 may have an outside diameter of substantially twelve inches. The vertical height of the socket 36 may be about eight inches measured from the roof of the socket 36 down to the lower end of the socket 36. The height of the wrench flats 38 may be about six and one-half inches. The slope of the surface 70 (FIG. 4) may be about forty-five degrees (45°). The vertical distance between the upper ends of the wrench flats 38 and the roof 72 of the socket 36 may be about one and one-half inches. The neck 34 may have a vertical height of about four inches and an outside diameter of about seven and one-quarter inches. The mounting flange 30 may have a thickness of about two inches. The eight holes 40 may have an inside diameter of about one inch and the distance between the holes 40 may be about seven and one-quarter inch. The center passageway in the socket wrench attachment (SRA) is or may be about two inches in diameter.

The illustrated embodiment presents a single example of the present invention and, therefore, is non-limitive. The use of eight wrench flats on the pipe piling sections PP is preferred. However, the number of wrench flats can vary. For example, in another installation, there may be six wrench flats or four wrench flats or five wrench flats, etc. It is to be understood that many other changes in the particular structure, materials and features of the invention may be made without departing from the spirit and scope of the invention. Therefore, my patent rights are not to be limited by the particular embodiment that is illustrated and described herein, but rather is to be determined by the following claims, interpreted according to accepted doctrines of patent claim interpretation, including use of the doctrine of equivalents.

What is claimed is:

1. Apparatus for placing steel pipe piling in the ground, comprising:

a rotary drive mechanism guided for up and down movement, and including a rotary output shaft, a rotary output member on said rotary output shaft, said rotary output member and said rotary output shaft having a common axis of rotation, and splines between the rotary output member and the rotary output shaft, said splines transferring rotation from the rotary output shaft to the rotary output member, and permitting the rotary output member to move axially up and down along the rotary output shaft;

a rotary socket wrench attachment for said rotary output member, said rotary socket wrench attachment having an upper end mounting flange, a lower end socket wrench, and a reduced diameter neck axially between the mounting flange and the socket wrench, the socket wrench has an axial socket including internal wrench flats;

an array of bolt fasteners surrounding the axis of rotation radially outwardly from the axial socket, said fasteners connecting the mounting flange of the socket wrench attachment to the rotary output member; and a rotary steel piling section having an upper end portion fitable into the socket wrench socket, said upper end portion including wrench flats adapted to engage the wrench flats in the socket wrench socket.

2. The apparatus of claim 1, further comprising a tower and a carriage movable up and down along said tower, said carriage including the rotary drive mechanism.

3. The apparatus of claim 2, wherein the tower is portable and can be moved to places where it is desired to place steel pipe piling in the ground.

4. The apparatus of claim 1, wherein the socket wrench socket is formed by an annular wall, and said bolt fasteners lie on a circle that is radially between the inner and outer surfaces of the socket wrench socket.

* * * * *